US008597070B2

(12) United States Patent
Chang et al.

(10) Patent No.: US 8,597,070 B2
(45) Date of Patent: Dec. 3, 2013

(54) PLANT IMITATING DEVICE

(75) Inventors: Chung-Liang Chang, Pingtung County (TW); Ming-Fong Sie, Pingtung County (TW)

(73) Assignee: National Pingtung University of Science and Technology, Neipu Hsiang (TW)

( * ) Notice: Subject to any disclaimer, the term of this patent is extended or adjusted under 35 U.S.C. 154(b) by 414 days.

(21) Appl. No.: 13/072,854

(22) Filed: Mar. 28, 2011

(65) Prior Publication Data

US 2011/0275275 A1 Nov. 10, 2011

(30) Foreign Application Priority Data

May 4, 2010 (TW) ..... 99114163 A

(51) Int. Cl.
*A63H 13/16* (2006.01)
*A63H 30/00* (2006.01)
*A63H 13/00* (2006.01)

(52) U.S. Cl.
USPC ..... 446/484; 446/175; 446/236; 446/489

(58) Field of Classification Search
USPC ..... 446/166, 175, 236, 268, 308, 309, 310, 446/314, 358, 359, 383, 486, 489; 40/406, 40/412, 427, 439, 477
See application file for complete search history.

(56) References Cited

U.S. PATENT DOCUMENTS

| | | | | | |
|---|---|---|---|---|---|
| 530,870 | A | * | 12/1894 | Wenger | 40/411 |
| 549,039 | A | * | 10/1895 | Wenger | 40/411 |
| 1,916,988 | A | * | 7/1933 | Pieschke | 40/412 |
| 4,738,881 | A | * | 4/1988 | Lee | 428/12 |
| 4,910,647 | A | * | 3/1990 | Gong | 362/122 |
| 4,973,891 | A | * | 11/1990 | Tzeng | 318/15 |
| 5,090,936 | A | * | 2/1992 | Satoh et al. | 446/175 |
| 5,522,758 | A | * | 6/1996 | Liu et al. | 446/310 |
| 2003/0110691 | A1 | | 6/2003 | Weder | |
| 2006/0254098 | A1 | * | 11/2006 | Fu | 40/411 |
| 2010/0293851 | A1 | | 11/2010 | Weder | |

* cited by examiner

*Primary Examiner* — Nini Legesse
(74) *Attorney, Agent, or Firm* — Alan Kamrath; Kamrath IP Lawfirm, P.A.

(57) ABSTRACT

A plant imitating device includes a body having a compartment and an opening in communication with the compartment. A driving unit is mounted in the compartment and includes a transmission member. A plant imitating unit is mounted in the compartment and includes an end facing the opening of the body. The plant imitating unit is engaged with the transmission member by a mounting portion. The plant imitating unit is movable relative to the transmission member. A control unit is electrically connected to the driving unit. The control unit controls the driving unit to cause the end of the plant imitating unit to move beyond the body via the opening. Thus, the end of the plant imitating unit gradually extends beyond the opening to imitate the growth of a plant.

10 Claims, 7 Drawing Sheets

PLANT IMITATING DEVICE

BACKGROUND OF THE INVENTION

1. Field of the Invention

The present invention relates to a plant imitating device and, more particularly, to a plant imitating device that can imitate the growth of a plant.

2. Description of the Related Art

Many busy modern people suffer from diseases of civilization, such as melancholia and anxiety disorder, due to the imbalance of body and mind resulting from stress in work and daily life. People choose some ways to obtain physical and mental relaxation, such as by implanting plants. However, busy as they are, they can not spend enough time and energy to take care of the plants. The plants die easily, failing to soothe the feeling and failing to provide distraction from boredom.

Due to the improvement in technology, mechanical systems imitating plants have been developed to avoid the above disadvantages. The literatures of plant ecology are gathered first to know the characteristics of the plants, such as the shapes and actions. Then, various detecting elements (such as sound control type or touch control type) are selected according to the characteristics of the plants to provide interaction between the plants and the user. However, conventional plant imitating devices currently available in the market can only imitate swaying of the plants, which is monotonous and fails to provide entertainment.

Thus, a need exists for an improved plant imitating device providing entertainment in addition to imitating the plant.

SUMMARY OF THE INVENTION

An objective of the present invention is to provide a plant imitating device that can imitate the growth of a plant to provide entertainment.

Another objective of the present invention is to provide a plant imitating device that can imitate the action of a plant based on relevant parameters in an environment to enhance the imitating effect.

The present invention fulfills the above objectives by providing a plant imitating device including a body having a compartment and an opening in communication with the compartment. A driving unit is mounted in the compartment and includes a transmission member. A plant imitating unit is mounted in the compartment and includes an end facing the opening of the body. The plant imitating unit is engaged with the transmission member by a mounting portion. The plant imitating unit is movable relative to the transmission member. A control unit is electrically connected to the driving unit. The control unit controls the driving unit to cause the end of the plant imitating unit to move beyond the body via the opening. Thus, the end of the plant imitating unit gradually extends beyond the opening to imitate the sprouting and growth of a plant from soil, providing entertainment.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 1:
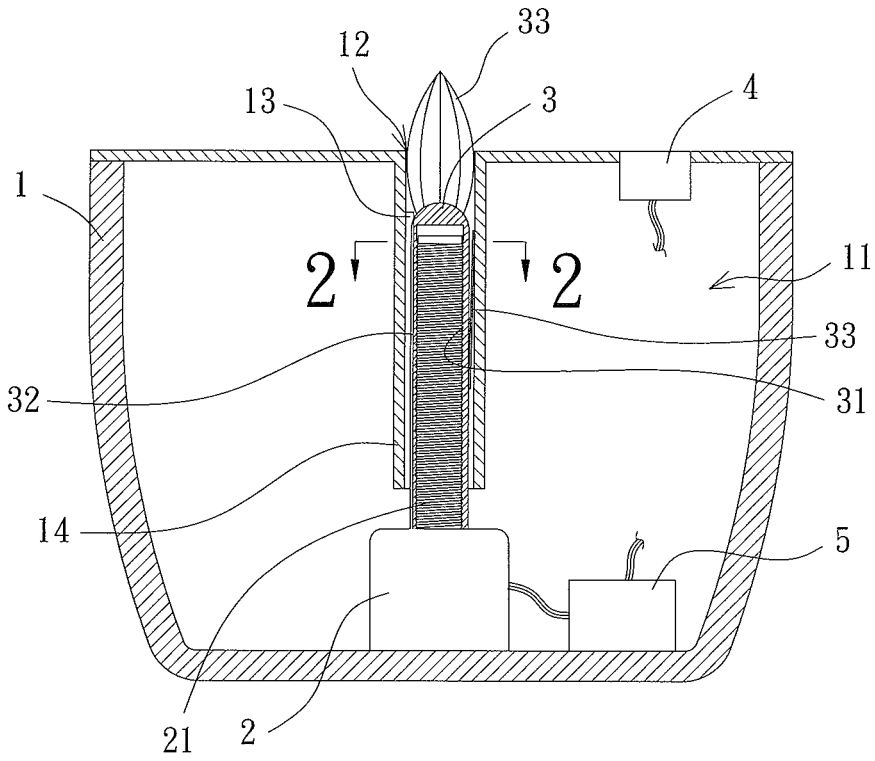
FIG. 1 shows a cross sectional view of a plant imitating device of a first embodiment according to the present invention.
Figure 2:
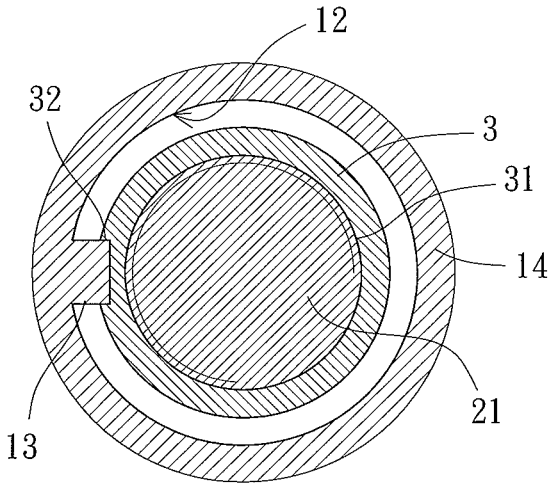
FIG. 2 shows a cross sectional view taken along section line 2-2 of FIG. 1.

With reference to FIGS. 1 and 2, a plant imitating device of a first embodiment according to the present invention includes a body 1, a driving unit 2, a plant imitating unit 3, a detecting unit 4, and a control unit 5. All of the driving unit 2, the plant imitating unit 3, the detecting unit 4, and the control unit 5 are mounted in the body 1. The driving unit 2 drives the plant imitating unit 3. The control unit 5 is electrically connected to the driving unit 2 and the detecting unit 4.

The body 1 is in the form of a pot and includes a compartment 11 for receiving and positioning the driving unit 2, the plant imitating unit 3, and the control unit 5. The body 1 includes an opening 12 and a first restraining portion 13. The opening 12 is preferably formed in a top face of the body 1 and in communication with the compartment 11. The first restraining portion 13 is preferably located in an inner periphery of the opening 12. In this embodiment, the body 1 includes a limiting passageway 14 having an end in communication with the opening 12. The limiting passageway 14 limits the moving path of the plant imitating unit 3. Furthermore, the first restraining portion 13 can be formed in an inner periphery of the limiting passageway 14.

The driving unit 2 is a motor and includes a transmission member 21 in the form shown as a screw rod. The transmission member 21 is received in the limiting passageway 14 and aligned with the opening 12.

The plant imitating unit 3 is in the form of a sleeve corresponding to the screw rod. The plant imitating unit 3 is preferably made of flexible material and includes an outer periphery having differing ornamental patterns resembling the shapes of the stalk of a plant. The plant imitating unit 3 includes a mounting portion 31 and a second restraining portion 32. The mounting portion 31 is mounted to an inner periphery of the plant imitating unit 3. In the form shown, the mounting portion 31 includes an inner threading threadedly engaged with the screw rod. The second restraining portion 32 is mounted on an outer periphery of the plant imitating unit 3 and movably engaged with the first restraining portion 13. When the driving unit 2 drives the transmission member 21 to rotate, the first and second restraining portions 13 and 32 avoid the plant imitating unit 3 from rotating synchronously with the transmission member 21. Thus, the plant imitating unit 3 moves along the outer periphery of the transmission member 21 in a vertical direction. Furthermore, the outer periphery of the plant imitating unit 3 preferably includes an ornament 33 in the form of a flower and/or leaves of the plant. The ornament 33 has a free end.

The first restraining portion 13 in this embodiment is in the form of a protrusion, and the second restraining portion 32 is in the form of a groove slideably receiving the protrusion. However, other arrangements of the first and second restraining portions 13 and 32 can be used. As an example, the first restraining portion 13 can be in the form of a groove, and the second restraining portion 32 can be in the form of a protrusion slideably received in the groove.

The detecting unit 4 detects a relevant parameter in the environment, such as a light source, sound, or temperature. The detecting unit 4 sends a detection signal to the control unit 5. In this embodiment, the detecting unit 4 detects the light source.

The control unit 5 sends a control signal to the driving unit 2 based on the detection signal from the detecting unit 4. Thus, the driving unit 2 can be activated to cause movement of the plant imitating unit 3 imitating the action of the plant.

Figure 3:
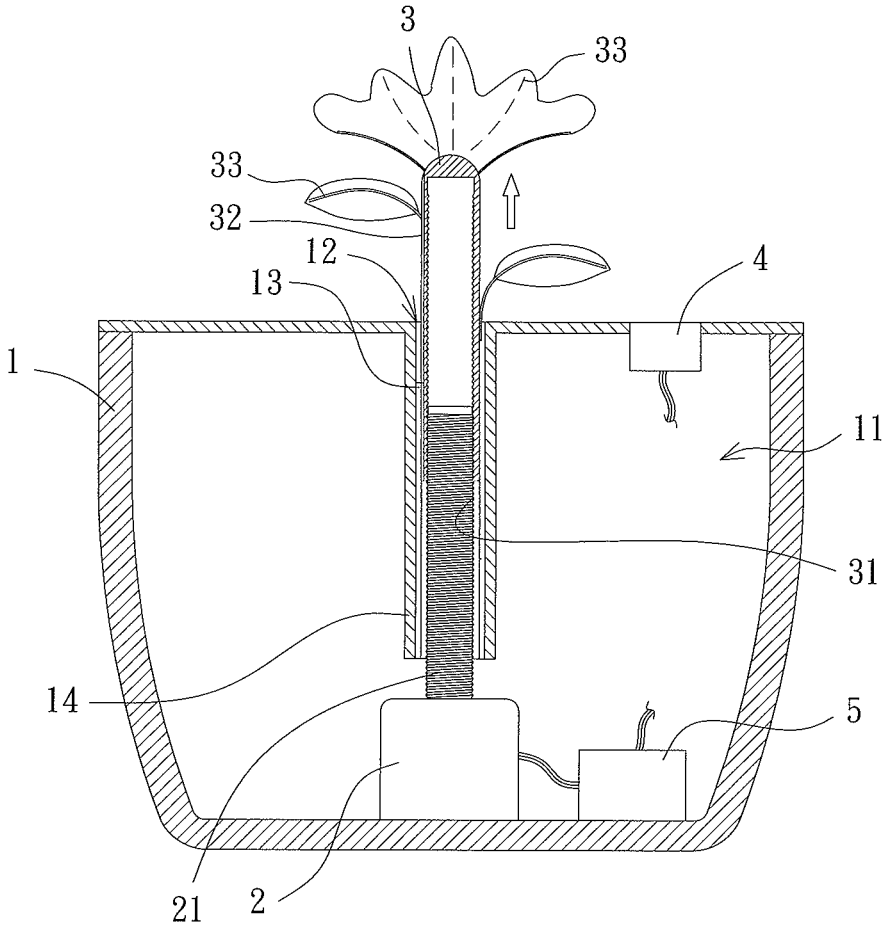
FIG. 3 shows a cross sectional view similar to FIG. 1, illustrating use of the plant imitating device.
Figure 4:
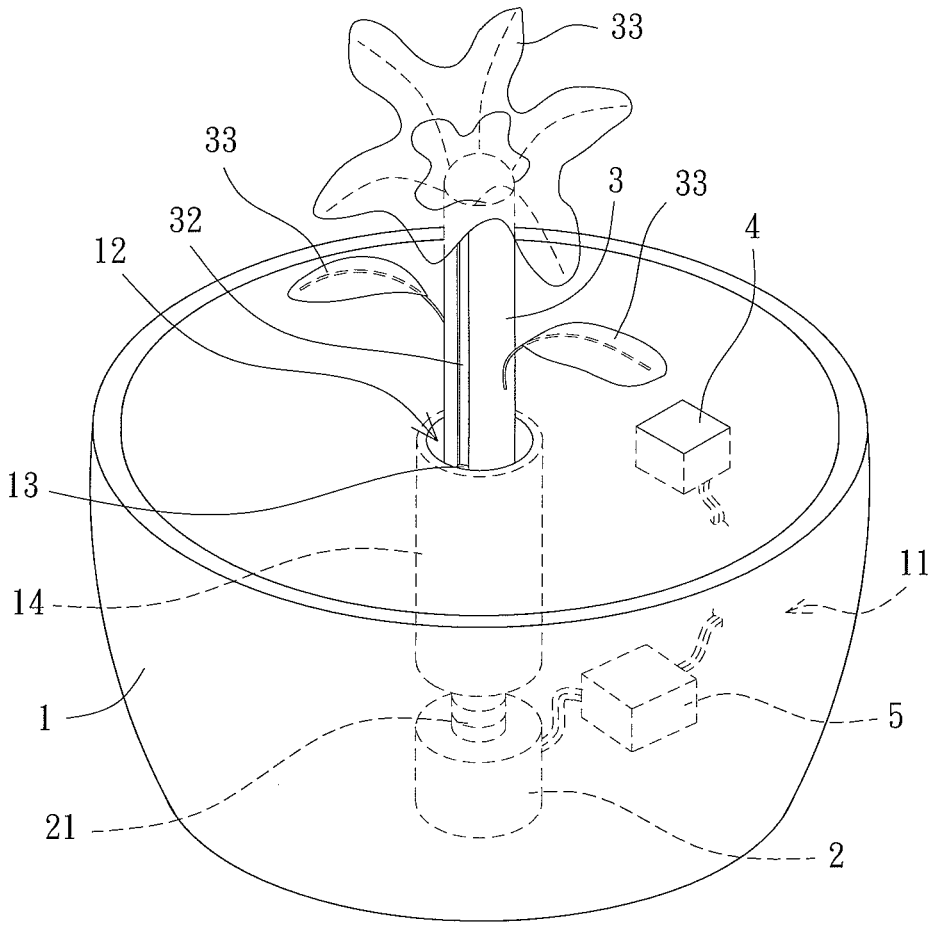
FIG. 4 shows a perspective view of the plant imitating device of FIG. 1, illustrating imitation of growth of a plant.

With reference to FIGS. 3 and 4, in use, when the detecting unit 4 detects the presence of a light source, the transmission member 21 of the driving unit 2 is driven to rotate by the control unit 5, causing the plant imitating unit 3 to move upward along the limiting passageway 14. A top end of the plant imitating unit 3 moves beyond the body 1 after passing through the opening 12. Thus, the exposed portion of the plant imitating unit 3 outside of the body 1 gradually increases, which is similar to the sprouting and growth of the plant from the soil. When the plant imitating unit 3 reaches a predetermined height, the free end of the ornament 33 is no longer restrained by the limiting passageway 14 and can move outward. Since the plant imitating unit 3 is made of flexible material, the plant imitating unit 3 slightly bends downward under the action of gravity, further enhancing the imitating effect. Thus, the growth of the plant can be effectively imitated.

In the plant imitating device of the first embodiment, the detecting unit 4 detects the relevant parameter in the environment, so that the control unit 5 drives the plant imitating unit 3 to gradually move upward by the transmission member 21. The plant imitating unit 3 initially in the limiting passageway 14 can extend outward, and the ornament 33 can extend outward together with the plant imitating unit 3, effectively imitating the sprouting and growth of the plant from the soil, providing entertainment.

Figure 5:
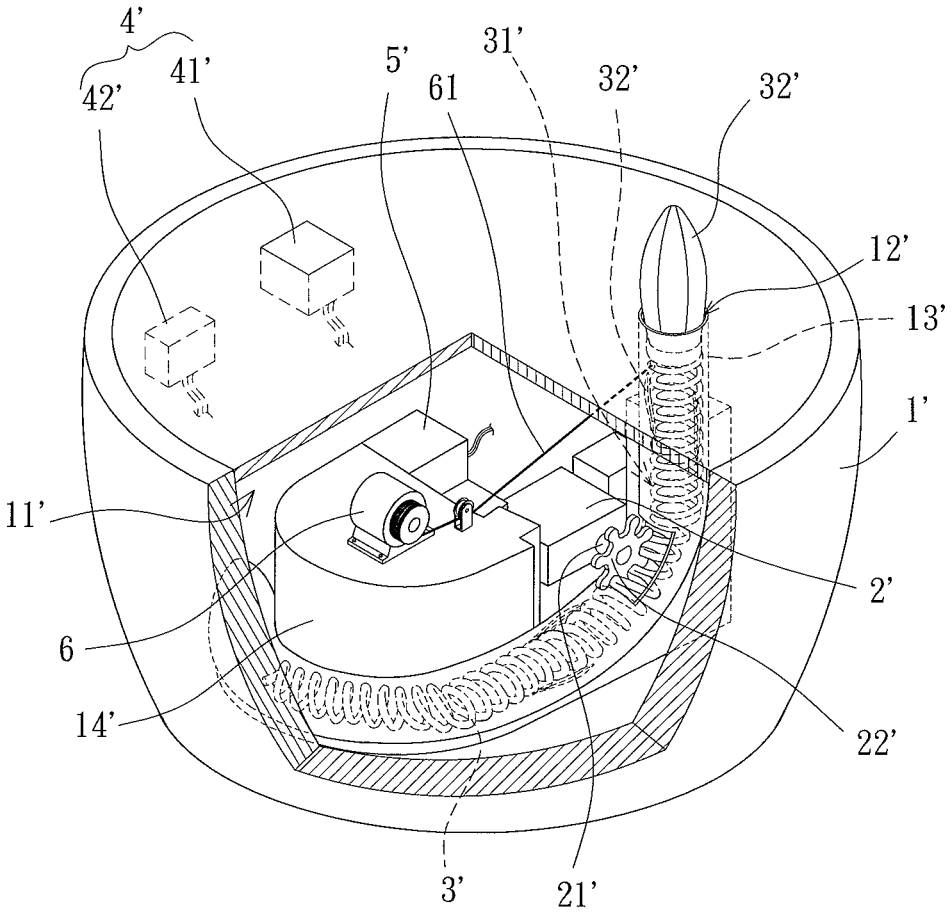
FIG. 5 shows a perspective view of a plant imitating device of a second embodiment according to the present invention, with portions broken away.
Figure 6:
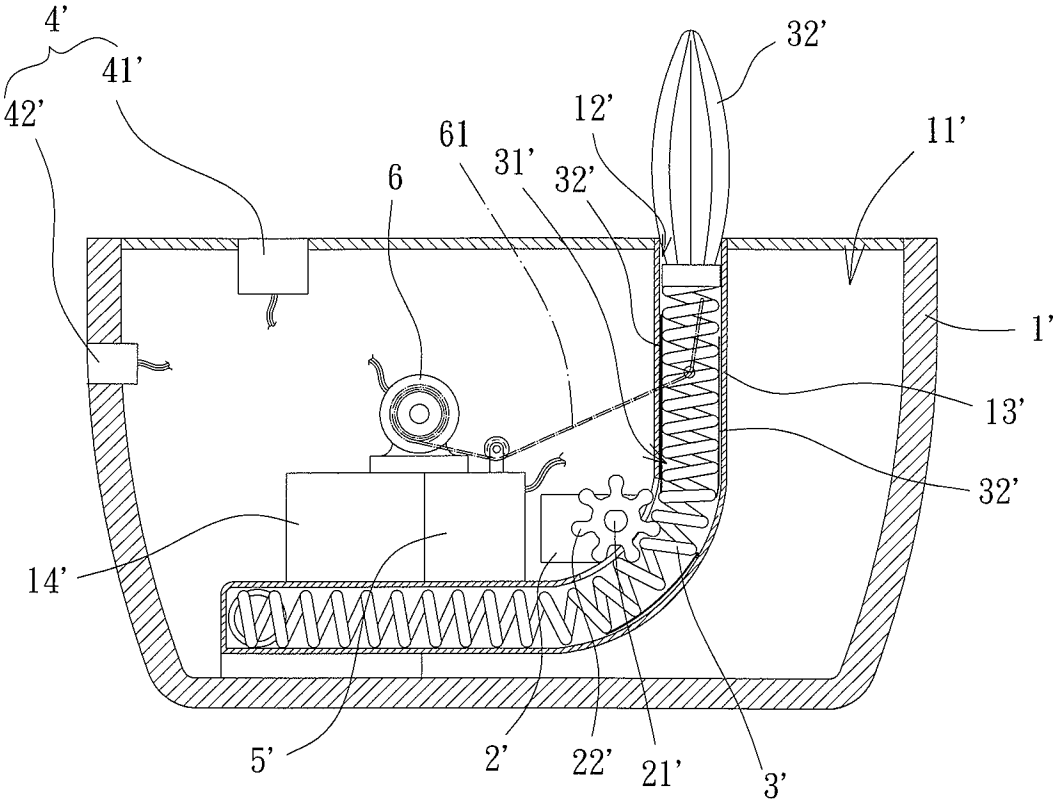
FIG. 6 shows a cross sectional view of the plant imitating device of FIG. 5.

FIGS. 5 and 6 show a plant imitating device of a second embodiment according to the present invention. Compared to the first embodiment, the plant imitating device of the second embodiment includes a body 1', a driving unit 2', a plant imitating unit 3', a detecting unit 4', a control unit 5', and an auxiliary driving unit 6. All of the driving unit 2', the plant imitating unit 3', the detecting unit 4', the control unit 5', and the auxiliary driving unit 6 are mounted in the body 1'. Both of the driving unit 2' and the auxiliary driving unit 6 are used to drive the plant imitating unit 3'. The control unit 5' is electrically connected to the driving unit 2', the detecting unit 4', and the auxiliary driving unit 6.

In this embodiment, the body 1' includes a compartment 11', an opening 12', and a limiting passageway 13'. The compartment 11' and the opening 12' are the same as the compartment 11 and the opening 12 of the first embodiment. The limiting passageway 13' is preferably defined around a fixed seat 14'. In addition to limiting the moving path of the plant imitating unit 3', the limiting passageway 13' serves as a storage space such that the plant imitating unit 3' can coil around the fixed seat 14'.

In this embodiment, the driving unit 2' includes a transmission shaft 21' having a transmission member 22' in the form of a gear. An end of the transmission member 22' extends into the limiting passageway 13'.

In this embodiment, the plant imitating unit 3' is preferably made of flexible material and received in the limiting passageway 13'. A mounting portion 31' is provided on an outer periphery of the plant imitating unit 3'. The mounting portion 31' is in the form of a toothed portion meshed with the gear. Preferably, an ornament 32' is provided on the outer periphery of the plant imitating unit 3' and has a free end.

The detecting unit 4' preferably includes first and second detecting elements 41' and 42'. The first detecting element 41' is a light source detector, and the second detecting element 42' is a sound detector. Specifically, the first detecting element 41' detects the presence of a light source and sends a first detection signal to the control unit 5'. The second detecting element 42' detects sound and sends a second detection signal to the control unit 5'.

The control unit 5' sends first and second control signals respectively based on the first and second detection signals to the driving unit 2' and the auxiliary driving unit 6. The driving unit 2' and the auxiliary driving unit 6 drive the plant imitating unit 3, imitating the action of the plant.

The auxiliary driving unit 6 includes a string 61 having an end fixed to an appropriate location on the plant imitating unit 3', such as the top portion. When the plant imitating unit 3' moves and, thus, pulls the string 61, the string 61 actuates a transmission mechanism or a rotating mechanism (not shown) of the auxiliary driving unit 6 to rotate synchronously, changing the length of the string 61 and imparting predetermined tension force to the string 61, which can be easily achieved by one having ordinary skill in the art.

Figure 7:
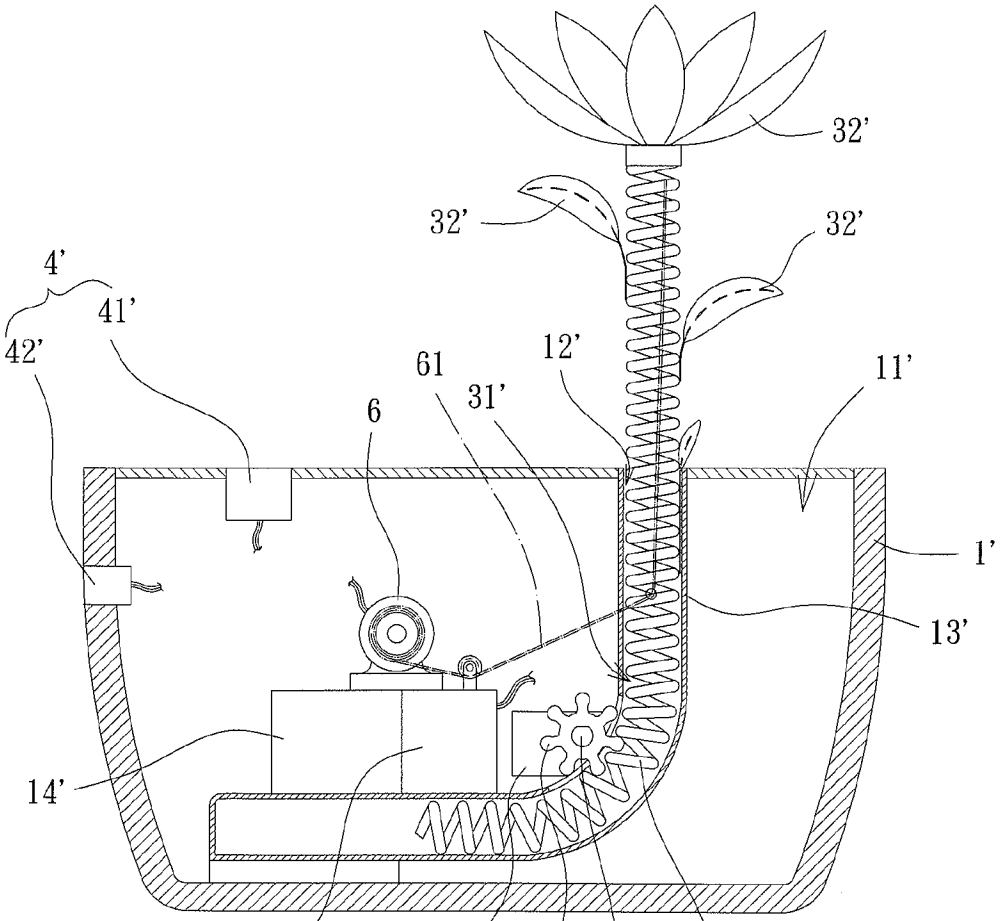
FIG. 7 shows a cross sectional view similar to FIG. 6, illustrating imitation of growth of a plant.
Figure 8:
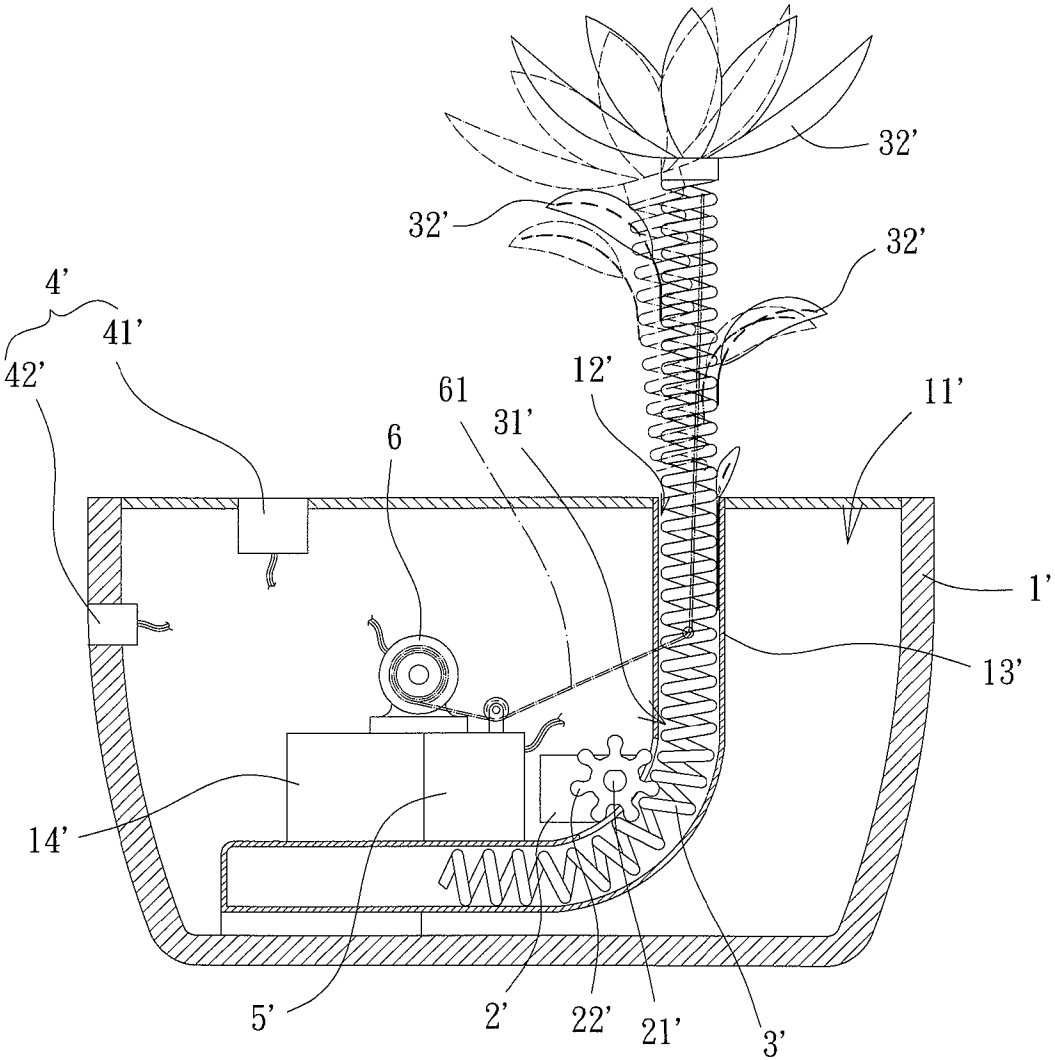
FIG. 8 shows a cross sectional view similar to FIG. 6, illustrating imitation of swaying of leaves of the plant.

With reference to FIGS. 7 and 8, in use, the first detecting element 41' detects the presence of the light source such that the control unit 5' controls the driving unit 2' to move the plant imitating unit 3' upward along the limiting passageway 13', imitating the sprouting and growth of the plant. Furthermore, the second detecting element 42' detects the presence of sound such that the control unit 5' controls the auxiliary driving unit 6 to pull the plant imitating unit 3' through the string 61, causing swaying movement of the plant imitating unit 3 to imitate the swaying of the plant blown by a breeze, enhancing the imitating effect.

Conclusively, in the plant imitating device according to the present invention, the detecting unit 4, 4' detects the relevant parameters in the environment, so that the control unit 5, 5' drives the plant imitating unit 3' to gradually move upward by the transmission member 21, 22', imitating the sprouting and growth of the plant and providing entertainment. Furthermore, the auxiliary driving unit 6 can sway the plant imitating unit 3' to imitate subtle swaying of the plant, further enhancing the imitating effect and providing more entertainment.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A plant imitating device comprising:

a body including a compartment and an opening in communication with the compartment;

a driving unit mounted in the compartment, with the driving unit including a transmission member;

a plant imitating unit mounted in the compartment and including an end facing the opening of the body, with the plant imitating unit engaged with the transmission member by a mounting portion, with the plant imitating unit movable relative to the transmission member; and a control unit electrically connected to the driving unit with the control unit controlling the driving unit to cause the end of the plant imitating unit to move beyond the body via the opening, with the control unit controlling the driving unit to cause the end of the plant imitating unit to move beyond the body via the opening, with the transmission member being a screw rod, with the mounting portion including an inner threading defined in an inner periphery of the plant imitating unit, with the inner threading engaged with the screw rod.

2. The plant imitating device as claimed in claim 1, further comprising a detecting unit electrically connected to the control unit, with the detecting unit sending a detection signal to the control unit based on an environmental parameter.

3. The plant imitating device as claimed in claim 1, with the body including a first restraining portion in the opening, with the plant imitating unit including an outer periphery having a second restraining portion, with the second restraining portion movably engaged with the first restraining portion.

4. The plant imitating device as claimed in claim 3, with the compartment including a limiting passageway therein, with the limiting passageway including an end in communication with the opening of the body, with the plant imitating unit received in the limiting passageway.

5. The plant imitating device as claimed in claim 1, with the compartment including a limiting passageway therein, with the limiting passageway including an end in communication with the opening of the body, with the plant imitating unit received in the limiting passageway.

6. The plant imitating device as claimed in claim 1, with the plant imitating unit further including an ornament having an end mounted to an outer periphery of the plant imitating unit, with another end of the ornament being a free end.

7. A plant imitating device comprising:

a body including a compartment and an opening in communication with the compartment;

a driving unit mounted in the compartment, with the driving unit including a transmission member;

a plant imitating unit mounted in the compartment and including an end facing the opening of the body, with the plant imitating unit engaged with the transmission member by a mounting portion, with the plant imitating unit movable in a moving path relative to the transmission member; and a control unit electrically connected to the driving unit with the control unit controlling the driving unit to move the end of the plant imitating unit beyond the body via the opening, with the transmission member being a gear, with the mounting portion being a toothed portion on an outer periphery of the plant imitating unit, with the toothed portion meshed with the gear, with the toothed portion having a first end and a second end spaced along the moving path from the first end, with the second end of the toothed portion intermediate the end of the plant imitating unit and the first end of the toothed portion, with the first end of the toothed portion mounted in the compartment of the body, with the second end of the toothed portion extending beyond the body or extending back into the body via the opening, and with the toothed portion engaging with the gear intermediate the first end and the second end of the toothed portion.

8. The plant imitating device as claimed in claim 7, further comprising a detecting unit electrically connected to the control unit, with the detecting unit sending a detection signal to the control unit based on an environmental parameter.

9. The plant imitating device as claimed in claim 8, further comprising an auxiliary driving unit electrically connected to the control unit, with the auxiliary driving unit including a string having an end fixed to the plant imitating unit.

10. The plant imitating device as claimed in claim 9, with the detecting unit including a first detecting element and a second detecting element, with the first and second detecting elements respectively sending first and second detection signals to the control unit, with the control unit sending first and second control signals based on the first and second detection signals to the driving unit and the auxiliary driving unit, respectively.

* * * * *